United States Patent [19]

Kosky

[11] 4,262,395

[45] Apr. 21, 1981

[54] SLIDING CLASP FASTENING MEANS

[75] Inventor: Julius Kosky, Edgware, England

[73] Assignee: Hans Bud, London, England

[21] Appl. No.: 18,466

[22] Filed: Mar. 7, 1979

[30] Foreign Application Priority Data

Mar. 9, 1978 [GB] United Kingdom ..... 9406/78

[51] Int. Cl.[3] ..... A44B 19/00

[52] U.S. Cl. ..... 24/201 C; 24/205.12; 24/205.13 R

[58] Field of Search ..... 24/201 C, 205.12, 205.13 R

[56] References Cited

U.S. PATENT DOCUMENTS

| | | | |
|---|---|---|---|
| 1,452,372 | 4/1923 | Gomez | 24/205.13 R |
| 1,706,097 | 3/1929 | Aud | 24/201 C |
| 2,606,351 | 8/1952 | Wende | 24/201 C |
| 2,658,250 | 11/1953 | Koutnik | 24/201 C |
| 3,230,593 | 1/1966 | Herz | 24/205.12 |
| 3,338,284 | 8/1967 | Ausnit | 24/201 C |
| 3,426,396 | 2/1969 | Laguerre | 24/201 C |
| 3,430,329 | 3/1969 | Ausnit | 24/201 C |
| 3,660,875 | 5/1972 | Gutman | 24/201 C |
| 3,848,298 | 11/1974 | Frohlich | 24/201 C |
| 4,004,327 | 1/1977 | Fukuroi et al. | 24/205.13 R |

*Primary Examiner*—Victor N. Sakran

*Attorney, Agent, or Firm*—Salter & Michaelson

[57] ABSTRACT

In sliding clasp fastening means comprising longitudinally extending mating strips and a U-shaped sliding clasp providing a channel fitting over the strips, the channel width tapering in the longitudinal direction of the strips and having adjacent the end thereof of greater width a pillar which fits between and holds the strips apart so that reciprocal movements of the clasp cause engagement or disengagement of the strips, the provision on one or both sides of the channel of means adapted to receive a tool operable to effect resilient separation of the sides of the channel to facilitate fitting of the clasp over the strips.

9 Claims, 8 Drawing Figures

SLIDING CLASP FASTENING MEANS

Figure 1:
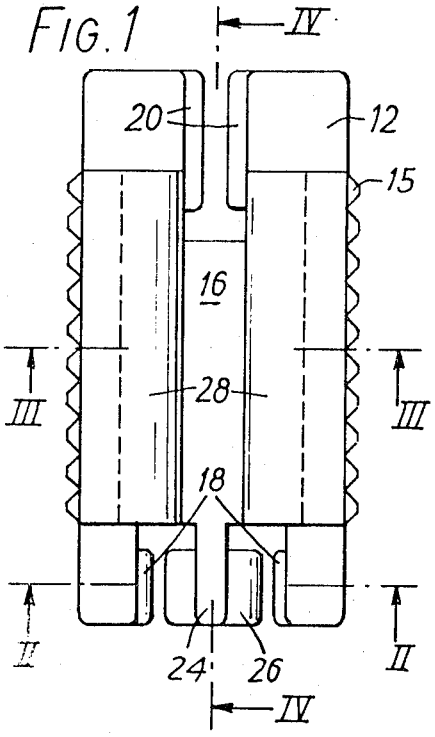

This invention relates to sliding clasp fastening means, and more particularly, to such means of the kind comprising longitudinally extending mating strips having complementary male and female cross-sections and a sliding clasp of generally U-shaped cross-section providing a channel fitting over the strips, the channel width tapering in the longitudinal direction of the strips and having, adjacent the end thereof of greater width, a pillar which fits between and holds apart the strips whereby, upon movement of the clasp along the strips with the pillar leading in the direction of movement the strips are forced into interlocking engagement by the sides of the channel whilst movement of the clasp in the reverse direction causes the pillar to effect separation of the strips.

The mating strips of sliding clasp fastening means of the kind referred to are formed for use with thin gauge plastics bags either by being extruded and subsequently welded to and along opposite sides of the mouth of the bag or by being extruded together with and within a cylindrical sleeve of thin gauge sheet plastics so that the strip can be placed into interlocking engagement by folding the sleeve at diametrically opposite directions thereby placing the interlocked strips near one of the folds. Material between the strips and the fold adjacent thereto is severed from the sleeve to provide free edges. The sleeve can then have a clasp fitted thereto in either of two ways. First, the sleeve is severed transversely to the mating strips in lengths equal to the required width of the bags and the clasp is mounted on the strips by sliding the clasp thereover from one end of the strips. Secondly and alternatively, the sleeve is moved intermittently through an interval equal to the desired width of a bag, and, at a suitable station a sliding clasp fastener is moved sidewards relatively to the strips and mechanically forced on to the strips after slight separation of the male and female strips and into sliding engagment therewith.

Neither the use of separate strips welded to the mouth of the plastics bag nor the arrangement in which the sleeve is severed prior to movement of a clasp over the strips from one end thereof is always acceptable. The alternative of forcing the clasp over the strips is satisfactory as regards speed of production but because of the flexibility of the clasp required to enable it to be forced into co-operative engagement with the strips, it is found in practice that if the bag is filled beyond a certain extent, the force of the contents on the sides of the bag frequently leads to the clasp being sprung out of engagement.

It is accordingly an object of this invention to provide improved sliding clasp fastening means of the kind set forth capable of high speed production and in which risk of the clasp being sprung off the mating strips is reduced.

The present invention consists in sliding clasp fastening means of the kind set forth which are characterised in that the clasp is formed at least at one side of a central longitudinal plane thereof extending between and generally parallel with the sides of the channel with means adapted to receive a tool operable to effect resilient separation of the sides of the channel to facilitate fitting of the clasp over the strips. It will be appreciated that by employing a tool to separate the sides of the channel when fitting the clasp over the strips, it becomes possible to use a clasp of stiffer material so that the resistance of the clasp to being sprung off the mating strip is improved.

Preferably, the clasp is formed at locations on respective opposite sides of the central longitudinal plane extending between the sides of the channel with means adapted to receive said tool. Advantageously, the clasp is formed on the bight of the U-shaped section thereof with mutually laterally spaced upstanding projections which are outwardly inclined and extend away from the sides of the channel, the projections, as the clasp is fitted to the strips, being gripped by the tool and thereby urged together so as resiliently to separate the channel sides to enable fitting of the clasp over the mating strips.

The invention also includes, for use in sliding clasp fastening means of the kind set forth, a clasp of generaly U-shaped cross-section providing a channel fitting over the strips, characterised in that the clasp is formed at least at one side of a central longitudinal plane thereof extending between and generally parallel with the sides of the channel with means adapted to receive a tool operable to effect resilient separation of the sides of the channel to facilitate fitting of the clasp over the strips. The clasp, preferably, is formed on respective opposite sides of the said central longitudinal plane with means adapted to receive said tool.

The invention further includes, in sliding clasp fastening means of the kind set forth, the method of mounting the clasp on the mating strips comprising gripping the clasp in a tool, operating the tool to increase the force exerted thereby on the clasp so as to effect resilient separation of the sides of the clasp, clamping the mating strips in disengaged facing relationship, advancing the clasp to the strips so as to engage the pillar thereof between the strips and the sides of the clasp respectively with the exterior of the strips, and releasing the force exerted by the tool on the clasp thereby to secure the clasp to the strips.

Figure 2:
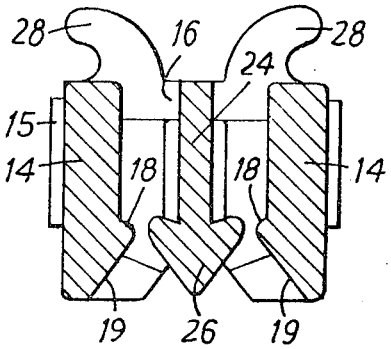
Figure 3:
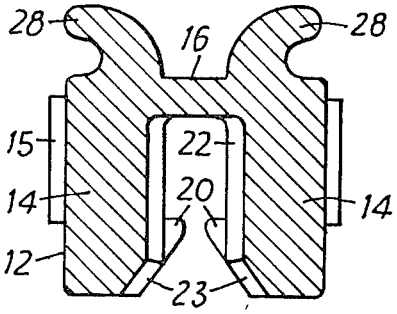
Figure 4:
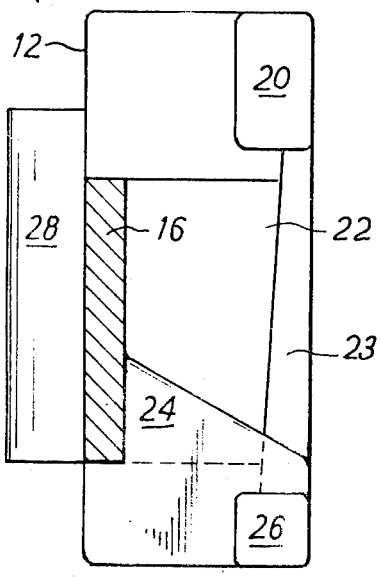
Figure 5:
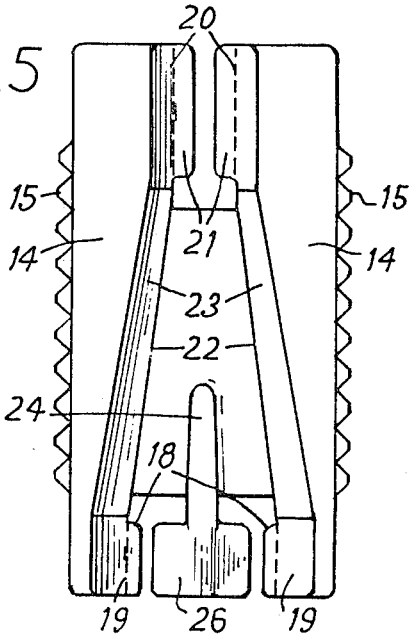
Figure 6:
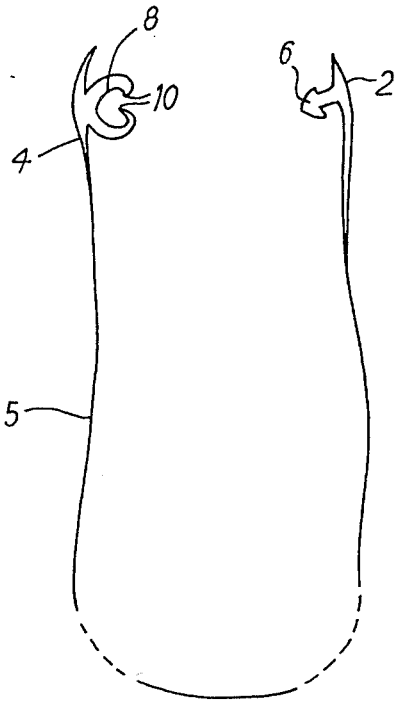
Figure 7:
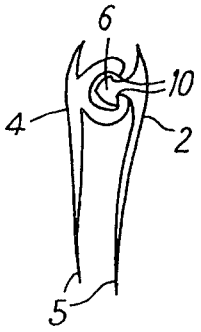
Figure 8:
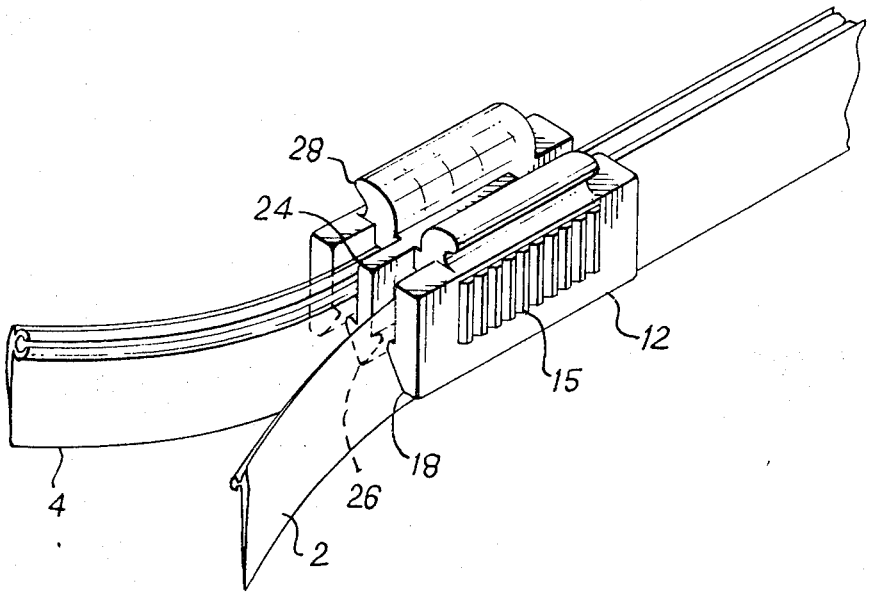

The invention will now be described by way of example with reference to the accompanying drawings in which:

FIG. 1 is a top plan view to an appreciably enlarged scale of a clasp for sliding clasp fastening means according to the invention, FIGS. 2 to 4 are sectional views on the lines II—II, III—III and IV—IV of FIG. 1, FIG. 5 is an underneath plan view of the clasp of FIG. 1, FIGS. 6 and 7 are rather diagrammatic cross-sectional views to a somewhat different scale from that of the other Figures of the mating strips of the fastening means of this invention, FIG. 6 illustrating the disengaged and FIG. 7 the engaged positions of the strips, and FIG. 8 is a perspective view showing the clasp of FIGS. 1 to 5 mounted upon the mating strips shown in FIGS. 6 and 7.

The sliding clasp fastening means illustrated in the drawings comprises longitudinal mating strips 2 and 4, seen in FIGS. 6 and 7 having complementary male and female cross-sections, the male cross-section being of an arrowhead form 6 and the female in the form of a recess 8 provided at its extremities with inwardly directed hooks 10 which, when the strips are pressed together, snap behind respective opposite sides of the arrowhead form 6 to inhibit separation of the strips.

The strips are extruded in one with thin plastics sheet 5, originally in generally cylindrical form, the sheet 5 being folded at diametrically opposite locations thereby to locate the strips 2 and 4 in facing relationship near one of the folds. The material of the sheet 5 between the strips and the adjacent fold is then severed. Plastics bags are then formed, as hereinafter described, by advancing the sheet intermittently and during each dwell of the sheet fitting a clasp at a clasp fitting station to the strips 2 and 4. Thereafter, and this part of the process is not hereinafter further described, the sheet 5 is severed transversely to the strips 2 and 4 at intervals, corresponding to the length of sheet moved between successive dwells, the severed edges of the sheet extending at right angles to the strips being so severed during heat sealing to close the side edges of the bags.

Referring now to FIGS. 1 to 5, the sliding clasp 12 is generally of U-shaped cross-section providing a channel having facing sides 14 and a transverse bottom or bight 16. For ease of handling, serrations 15 are formed on the exterior of each of the sides 14. At opposite ends thereof the sides 14 remotely from the channel bottom 16 are formed with parts 18 and 20 which are undercut and which include respective downwardly and outwardly inclined surfaces 19 and 21. Intermediate portions of the sides 14 have plane inner surfaces 22 terminating at their lower ends in downwardly and outwardly inclined surfaces 23. At the end of the sides 14 adjacent the undercut parts 18, there is provided a pillar 24 which extends from the channel bottom 16 between the sides of the channel and which is formed with an enlarged head 26 of arrowhead section, the head 26 being located between the parts 18. The downwardly and outwardly inclined surfaces 19, 21 and 23 together with the arrowhead form of the head 26 enable introduction, as will hereinafter appear, between the sides 14 of the clasp of the strips 2 and 4 each of which locates between the pillar 24 and one of the sides 14. It will be noted that the clasp sides 14 include the surfaces 22 which taper from the parts 18 to the parts 20 to produce a reducing width of the channel provided by the clasp. Thus, movement of the clasp when engaged with the strips 2 and 4 in the direction with the pillar 24 leading, causes the strips to be squeezed into interlocking engagement between the sides 14 of the clasp, whilst a reverse movement of the clasp causes the pillar to effect separation of the strips.

On the bottom 16, i.e. the bight, of the channel provided by the clasp are formed mutually laterally spaced upstanding projections 28 which are outwardly inclined and extend away from the channel. These projections can be gripped by a tool through which a force can be applied to move the projections 28 together thereby to separate the sides 14 of the channel to enable fitting of the clasp to the strips 2 and 4 during which movement of the strips into the clasp is directed by engagement thereof with the surfaces 19, 21 and 23 and the downwardly and inwardly facing surfaces of the head 26.

The clasp is formed from sufficiently stiff plastics material which is resiliently deformed when the projections 28 are moved together by the gripping tool. Accordingly, when the force exerted by the gripping tool is released the sides 14 return to their configuration illustrated in the drawings and are not likely to be prised apart by forces exerted thereon by the sides of the bag on which the strips 2 and 4 are formed.

The mounting of the clasp on the strips 2 and 4 takes place in the following manner. The sheet 5 is located on a conveyor with the strips 2 and 4 extending parallel with the longitudinal edges of the conveyor. At the same side of the conveyor as the strips 2 and 4 is provided a station to which are fed singly or in strips the clasps 12. On either side of this station are located pairs of gripping jaws between one pair of which and the station is provided a fixed post, which extends towards the sheet 5 and between the strips 2 and 4. The sheet 5 is advanced by the conveyor intermittently each step of the movement being equivalent to the width of bag it is desired to provide. On each occasion that the movement of sheet 5 is arrested, the pairs of gripper jaws are brought into clamping engagement with the strips 2 and 4 on either side of the post extending therebetween. A clasp supplied to the station between the gripping jaws is located with the surfaces 19, 21 and 23 facing the strips 2 and 4 and extending parallel with said strips. The projections 28 are engaged by a gripping tool and urged together as or before the clasp is advanced towards the strips 2 and 4 so that when the clasp arrives at the strips the sides 14 thereof have been resiliently separated by the tool to a sufficient extent to allow engagement of the outer surfaces of the strips 2 and 4 with the surfaces 19, 21 and 23 and engagement of the inner surfaces of the strips 2 and 4 with the surfaces of the head 26. The clasp is thus slid over the strips 2 and 4 and the force exerted by the gripping tool on the projections 28 is then released to allow the sides 14 of the clasp resiliently to move together and thereby trap the strips 2 and 4 within the channel of the clasp between the transverse bottom 16 thereof and the undercuts 18 and 20. The gripping tool is then withdrawn and the clamping jaws on opposite sides thereof released whereupon the sheet is advanced a further step so that a further clasp can then be fitted as described.

On each dwell of the sheet 5 a length of the sheet to which a clasp has been fitted is severed in a direction transversely to the strips 2 and 4. The edges of the severed portions extending transversely to the strips 2 and 4 are heat sealed simultaneously with the severing to close the side edges of the bag. The method enables high speed bag production with fitted sliding clasps which are resistant to removal by reason of the contents of the bag applying forces to the sides of the bag tending to force apart the sides of the clasp thereby to spring the clasp off the mating strips.

It will be appreciated that many changes can be made in the embodiment described without departing from the spirit of the invention. Thus, for example, instead of projections 28, projections of a different shape or other projections of the same side of the channel bottom 16 as the sides 14 of the clasp could be provided and gripped by a gripping tool which moved these projections apart in order resiliently to separate the sides 14 of the clasp. Also, the precise form of profile of the mating strips where the latter interlock may differ appreciably from the form described.

I claim:

1. Sliding clasp fastening means comprising longitudinally extending mating strips having complementary male and female cross-sections and a sliding clasp of a generally U-shaped cross-section providing a channel fitting over the strips, the channel width tapering in the longitudinal direction of the strips and having, adjacent the end thereof of greater width, a pillar which fits between and holds apart the strips whereby, upon movement of the clasp along the strips with the pillar leading in the direction of movement the strips are forced into interlocking engagement by the sides of the channel whilst movement of the clasp in the reverse direction causes the pillar to effect separation of the strips, characterised in that the clasp is formed at least at one side of a central longitudinal plane thereof extending between and generally parallel with the sides of the channel with means adapted to receive a tool operable to effect resilient separation of the sides of the channel to facilitate fitting of the clasp over the strips.

2. Sliding clasp fastening means as claimed in claim 1, characterised in that the clasp is formed at locations on respective opposite sides of the central longitudinal plane extending between the sides of the channel with means adapted to receive said tool.

3. Sliding clasp fastening means as claimed in claim 2, characterised in that the clasp is formed on the bight of the U-shaped section thereof with mutually laterally spaced upstanding projections which extend away from the sides of the channel and, as the clasp is fitted to the strips, are gripped by the tool and thereby urged together so as resiliently to separate the channel sides to enable fitting of the clasp over the mating strips.

4. A sliding clasp for use in sliding clasp fastening means of the kind comprising longitudinally extending mating strips having complementary male and female cross-sections and a sliding clasp of generally U-shaped cross-section providing a channel fitting over the strips, the channel width tapering in the longitudinal direction of the strips and having, adjacent the end thereof of greater width, a pillar which fits between and holds apart the strips whereby, upon movement of the clasp along the strips with the pillar leading in the direction of movement the strips are forced into interlocking engagement by the sides of the channel whilst movement of the clasp in the reverse direction causes the pillar to effect separation of the strips, characterised in that the clasp is formed at least at one side of a central longitudinal plane thereof extending between and generally parallel with the sides of the channel with means adapted to receive a tool operable to effect resilient separation of the sides of the channel to facilitate fitting of the clasp over the strips.

5. A sliding clasp as claimed in claim 4, characterised in that the clasp is formed on respective opposite sides of the said central longitudinal plane with means adapted to receive said tool.

6. A sliding clasp as claimed in claim 5, characterised in that the exterior surfaces of the sides of the channel are formed with means for facilitating gripping of the channel.

7. A sliding clasp as claimed in claim 6, characterised in that the means for facilitating gripping comprise serrations formed on the exterior surfaces of respective sides of the channel.

8. In sliding clasp fastening means comprising longitudinally extending mating strips having complementary male and female cross-sections and a sliding clasp of generally U-shaped cross-section providing a channel fitting over the strips, the channel width tapering in the longitudinal direction of the strips and having, adjacent the end thereof of greater width, a pillar which fits between and holds apart the strips whereby, upon movement of the clasp along the strips with the pillar leading in the direction of movement the strips are forced into interlocking engagement by the sides of the channel whilst movement of the clasp in the reverse direction causes the pillar to effect separation of the strips, the method of mounting the clasp on the mating strips comprising gripping the clasp in a tool, operating the tool to increase the force exerted thereby on the clasp so as to effect resilient separation of the sides of the clasp, clamping the mating strips in disengaged facing relationship, advancing the clasp to the strips so as to engage the pillar thereof between the strips and the sides of the clasp respectively with the exterior of the strips, and relasing the force exerted by the tool on the clasp thereby to secure the clasp to the strips.

9. The method claimed in claim 8, characterised in that the clamping of the mating strips in disengaged facing relationship is effected by introducing a post between the strips, at a location adjacent a station at which the clasp is advanced to the strips, and gripping the strips between pairs of gripping jaws located respectively on opposite sides of the post.

* * * * *